US005979416A

United States Patent [19]

Berger

[11] Patent Number: 5,979,416

[45] Date of Patent: Nov. 9, 1999

[54] PLUG-IN PUMP FOR AN INTERNAL COMBUSTION ENGINE

[75] Inventor: Frank Berger, Leutenbach, Germany

[73] Assignee: DaimlerChrysler AG, Stuttgart, Germany

[21] Appl. No.: 09/119,077

[22] Filed: Jul. 9, 1998

Related U.S. Application Data

[63] Continuation of application No. PCT/EP96/05891, Dec. 20, 1996.

[30] Foreign Application Priority Data

Jan. 9, 1996 [DE] Germany ..... 196 00 561

[51] Int. Cl.[6] ..... F02M 37/04

[52] U.S. Cl. ..... 123/509; 123/500; 123/468

[58] Field of Search ..... 123/509, 500, 123/501, 467, 508, 507, 468, 469, 456

[56] References Cited

U.S. PATENT DOCUMENTS

| | | | |
|---|---|---|---|
| 1,119,657 | 12/1914 | Steinbecker | 123/509 |
| 4,430,977 | 2/1984 | Shimada | 123/509 |
| 4,526,150 | 7/1985 | Guntert | 123/509 |
| 4,527,962 | 7/1985 | Clemens | 123/509 |
| 5,007,401 | 4/1991 | Grohn | 123/509 |
| 5,398,658 | 3/1995 | Mesimaki | 123/509 |
| 5,419,298 | 5/1995 | Nolte | 123/509 |
| 5,479,903 | 1/1996 | Werner | 123/509 |
| 5,564,395 | 10/1996 | Moser | 123/509 |
| 5,577,892 | 11/1996 | Schittler | 123/500 |

FOREIGN PATENT DOCUMENTS

| | | |
|---|---|---|
| 0 543 301 | 5/1993 | European Pat. Off. . |
| 40 40 937 | 6/1992 | Germany . |

*Primary Examiner*—Carl S. Miller

*Attorney, Agent, or Firm*—Evenson, McKeown, Edwards & Lenahan, P.L.L.C.

[57] ABSTRACT

A plug-in pump is provided for an internal combustion engine having a receiving bore in the cylinder block to accommodate the plug-in pump. The plug-in pump includes a pump plunger and a spring-loaded roller tappet driven by a cam of a camshaft. The longitudinal axis of the plug-in pump lies transversely in relation to the camshaft axis and at a distance from it, so that the longitudinal axis of the plug-in pump, seen in the direction of turn of the camshaft, lies in front of the camshaft axis.

14 Claims, 3 Drawing Sheets

PLUG-IN PUMP FOR AN INTERNAL COMBUSTION ENGINE

CROSS-REFERENCE TO RELATED APPLICATIONS

This application is a continuation under 35 U.S.C. 111(a) of pending international PCT Application No. PCT/EP96/05891, filed Dec. 20, 1996, and claims the priority of German application number 196 00 561.2, filed on Jan. 9, 1996, the disclosures of which are incorporated by reference herein.

BACKGROUND AND SUMMARY OF THE INVENTION

The invention relates to a plug-in pump for an internal combustion engine.

A plug-in pump of this kind is known from EP 0 543 301 A1 (especially FIG. 2) whose pump part and actuating part plug into a receiving bore in the cylinder block of an internal combustion engine. The pump part that has a pump piston in the pump housing is structurally separate from the actuating part with the roller tappet that is driven by the cam, but the pump and actuating part have an operating connection with one another. The lengthwise axis of the plug-in pump runs transversely to the axis of the camshaft and intersects the camshaft axis at its imaginary extension.

This camshaft also has cams that actuate the charge-changing valves of the internal combustion engine by push rods adjacent to the respective receiving bores of the plug-in pump of each cylinder.

The goal of the invention is to recover space in the cylinder block in its lengthwise extent by special positioning of the cam-driven plug-in pumps, while simultaneously improving the running behavior and/or the alignment of the rollers of the roller tappets that are guided in a lengthwise displaceable manner and, simultaneously with this special positioning, also to simplify installation and removal of the plug-in pumps in order to minimize the cost of repair resulting from normal wear.

These and other goals have been achieved according to the present invention by providing a plug-in pump for an internal combustion engine with a receiving bore provided in the cylinder block for the plug-in pump, said pump comprising a pump part with a pump piston guided in a pump housing and an actuating part with a cam-driven and spring-loaded roller tappet, and with a lengthwise axis of said pump extending transversely to a camshaft axis, piston guides for intake and exhaust valves of each cylinder being adjacent to the receiving bore of the plug-in pump, wherein an imaginary extension of the lengthwise axis of the plug-in pump at a distance from the camshaft axis such that the imaginary extension of the lengthwise axis of the plug-in pump intersects a plane that runs perpendicularly through the camshaft axis below the camshaft axis, the pump part and the actuating part being combined into a unit by a sleeve that fits around both parts and is inserted into the receiving bore, with the roller tappet being guided in the sleeve in a lengthwise displaceable manner.

By virtue of the positioning of the plug-in pumps according to the invention, whose lengthwise axes are located on their imaginary extensions at a specific distance from the camshaft axis and intersect a plane that runs perpendicularly through the axis of the camshaft below the camshaft axis, a greater distance from the cylinder axis and a closer spacing of the pushrod guides of the intake and exhaust valves is achieved so that the amount of space occupied lengthwise by the cylinder block can be reduced since the spacing of the cylinders arranged in line can be reduced. At the same time that space is gained, weight is reduced.

The pump part and actuating part of the plug-in pump according to the invention are combined in terms of design in a module by a sleeve that surrounds both parts and plugs into the receiving bore so that the pump part and actuating part can be removed in simple fashion from the cylinder block or can be plugged into the cylinder block as a one-piece element. Thus, the parts that are subject to wear are located in the plug-in pump and not in the cylinder block. No finishing work is required in the cylinder block when there are signs of wear. The unit is designed so it can be tested.

The special guidance of the roller tappet in the sleeve produces a form of protection against twisting that is not subject to difficulties.

By virtue of the special arrangement of the plug-in pump relative to the camshaft on the one hand and the special mounting of the roller tappet in the sleeve on the other, an alignment of the roller with the roller tappet is achieved that permits a much improved and/or more stable running behavior.

Although a cam-tappet system with a roller tappet for an injection pump is known from DE 40 40 937 A1, in which the roller axis is offset, this offset arrangement serves exclusively to prevent twisting.

A plug-in pump is known from DE 42 27 853A1 in which a thin-walled sliding sleeve is located between the roller tappet of the cam drive that can move back and forth in a bore in the block of the internal combustion engine. The rotational position of the roller tappet is secured by a pin and groove connection.

An advantageous improvement on the invention is obtained by the special arrangement of the fuel supply and the special design of the fuel connection in the critical area of two adjoining block parts.

Other objects, advantages and novel features of the present invention will become apparent from the following detailed description of the invention when considered in conjunction with the accompanying drawings.

DETAILED DESCRIPTION OF THE DRAWINGS

Figure 1:
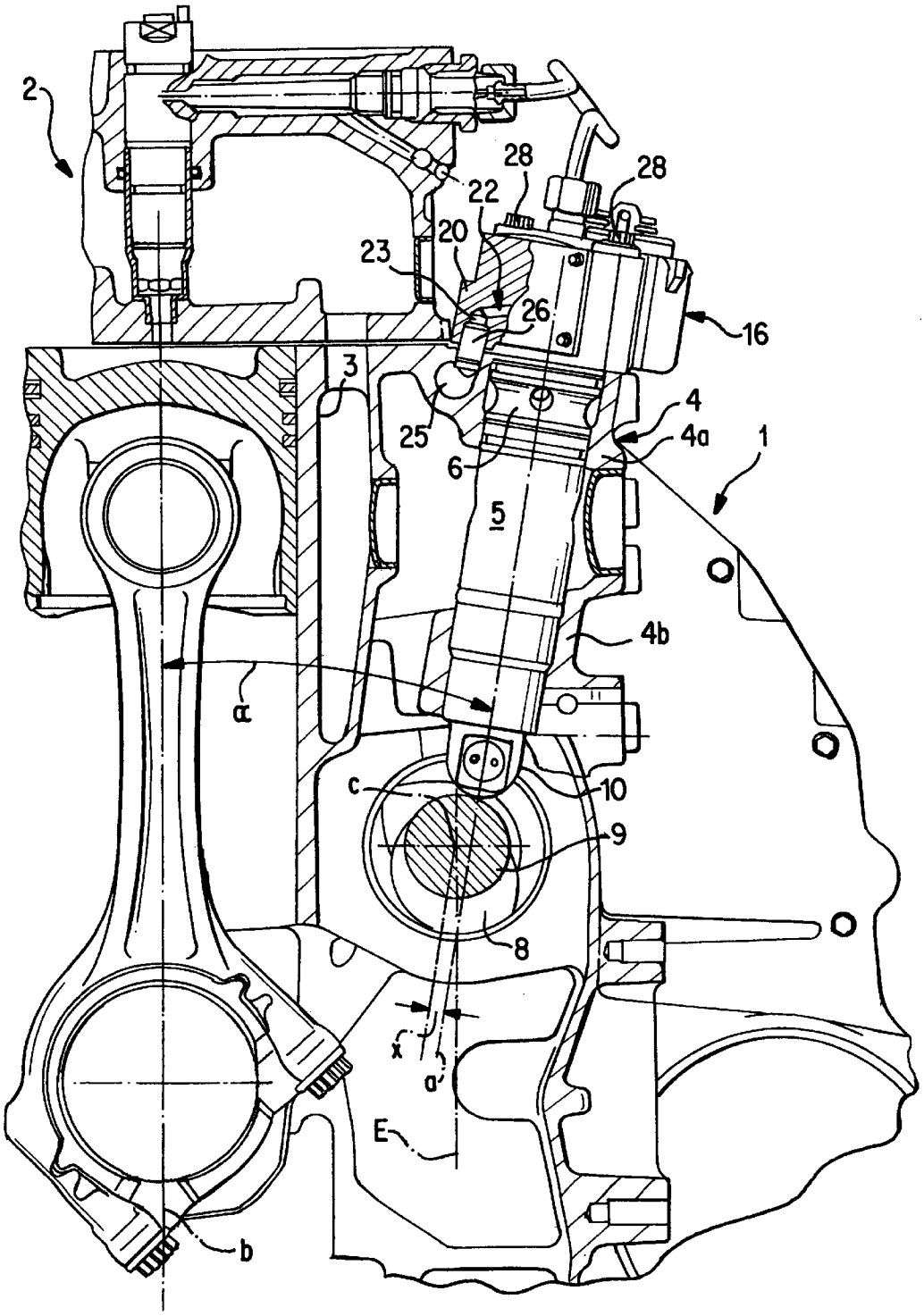
FIG. 1 is a cylinder block, shown in cross section, of a multicylinder internal combustion engine with a plug-in pump according to a preferred embodiment of the present invention.
Figure 2:
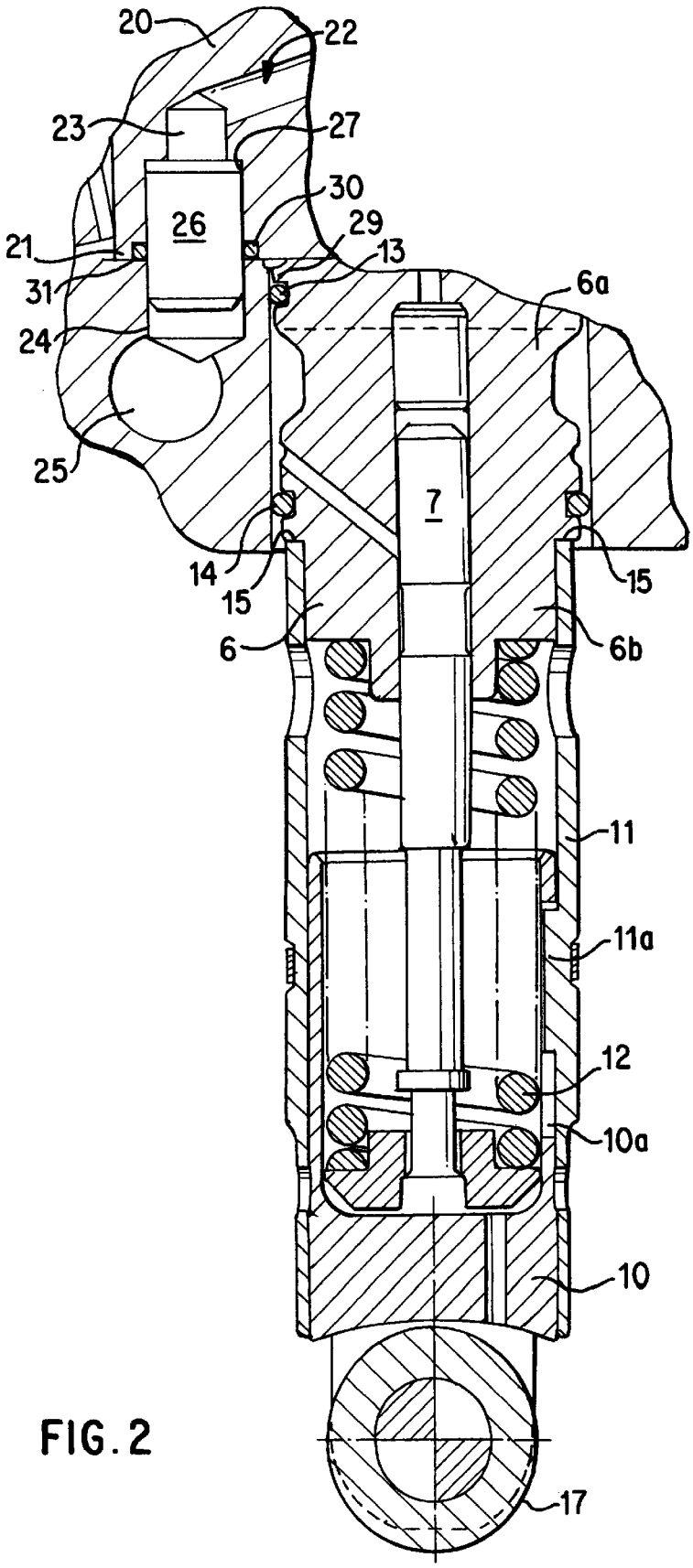
FIG. 2 shows the cylinder block with the plug-in pump of FIG. 1 in an enlarged view.
Figure 3:
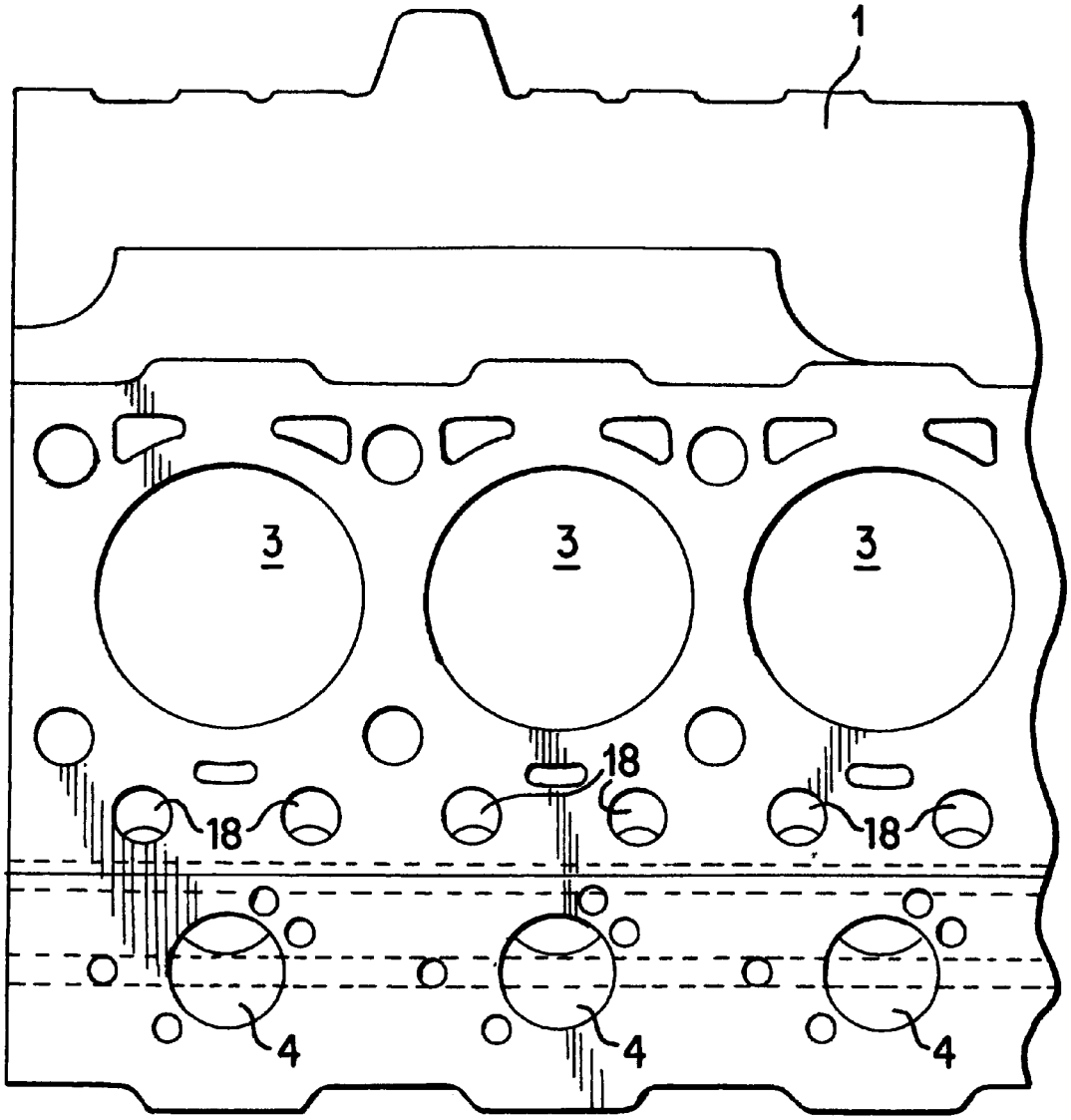
FIG. 3 shows the cylinder block of the internal combustion engine in a top view.

FIGS. 1 and 3 show a cylinder block 1 for a multicylinder internal combustion engine 2 with cylinders 3 arranged in line, as well as projecting receiving bores 4 provided in cylinder block 1 to receive solenoid-valve-controlled plug-in pumps 5. Each plug-in pump 5 associated with a cylinder 3 is composed of a pump part with a pump piston 7 guided in pump housing 6 and an actuating part with a roller tappet 10 that cooperates with the pump piston, is spring-loaded, and is driven by cam 8 on a camshaft 9.

The pump part and actuating part are combined to form a unit by an elongate sleeve 11 that surrounds both parts (FIG.

2), and plug into receiving bore 4 which is divided into bore sections 4*a* and 4*b* located with a distance between them. The lower part of pump housing 6 is inserted into bore section 4*a* which is at the top in cylinder block 1, while sleeve 11 is inserted into lower bore section 4*b*. Roller tappet 10 is guided in sleeve 11 against the force of a roller tappet spring 12 in a lengthwise displaceable fashion. A slider 11*a* that is integral with the sleeve and a slot-shaped slider guide 10*a* in roller tappet 10 provide a device to prevent loss, so that when plug-in pump 5 is removed from receiving bore 4, roller tappet 10 is prevented from falling out of sleeve 11.

The lower part of pump housing 6 is designed in stages, with part 6*a* that has the larger diameter having two sealing rings 13, 14 one on top of the other and mounted in bore section 4*a* at the top, and with part 6*b* that has the smaller diameter being permanently connected with the upper part of sleeve 11. A pressure shoulder 15 formed by the step on pump housing 6 thus rests on the end of sleeve 11.

Pump housing part 6 is exposed, projects from receiving bore 4, and contains a solenoid valve 16 to control the flow paths in the fuel lines.

The plug-in pump 5 is located so that its lengthwise axis a and cylinder axis b form an angle $\alpha$ of approximately 10° in the illustrated preferred embodiment, although this angle may vary and is not limiting.

The lengthwise axis a runs transversely to axis c of camshaft 9, with the imaginary extension of lengthwise axis a being located at a distance x from camshaft axis c such that the extended lengthwise axis a of plug-in pump 5 is located behind camshaft axis c, as viewed from cylinder 3 looking in the direction of camshaft 9. Thus the extended lengthwise axis a of plug-in pump 5 intersects a plane E that runs perpendicularly through axis c of camshaft 9 below the camshaft axis. The distance (x) between the imaginary extension of the lengthwise axis (a) of the plug-in pump and the camshaft axis (c) roughly corresponds to one-seventh of the diameter of the roller tappet in the illustrated preferred embodiment, although this distance may vary and is not limiting The direction of rotation of camshaft 9 is counter-clockwise (FIG. 1) which means that roller 17 of roller tappet 10 acts as a caster and thus exhibits improved running stability.

The special location and/or arrangement of plug-in pumps 5 with respect to camshaft 9 brings piston guides 18 of each cylinder 3 closer together and consequently the adjacent cylinders 3 can be located closer together (FIG. 3). Advantages include weight savings and reduced space requirements.

The exposed pump housing part that projects from receiving bore 4 is provided with a lateral housing projection 20. This part of the pump housing and housing projection 20 rest on a supporting surface 21 of cylinder block 1 that runs at right angles to lengthwise axis a of plug-in pump 5.

Lateral housing projection 20 has a fuel line 22 with a line section 23 that runs parallel to the lengthwise axis a of plug-in pump 5 and is designed with stages, said section being coaxial with respect to a supply channel 24 in cylinder block 1. Supply channel 24 branches off from a lengthwise channel 25 that extends in cylinder block 1 next to plug-in pumps 5 as a continuous fuel supply.

A sleeve 26 is inserted into line section 23 up to a pressure shoulder 27 that is formed by a step and secured there. Sleeve 26 has a part that projects from line section 23 to supply channel 24 of cylinder block 1 and forms a position-securing device for plug-in pump 5 in receiving bore 4. Plug-in pump 5 is fastened to cylinder block 1 by mounting bolts 28.

Supporting surface 29 on housing projection 20 that is located opposite supporting surface 21 on cylinder block 1 is provided with a recess 30 that surrounds sleeve 26, in which recess a sealing ring 31 rests, said ring being pushed under pretension against sleeve 26 to prevent loss. Sleeve 26 which creates the line connection between cylinder block 1 and the plug-in pump in this special way protects sealing ring 31 against the very high system pressure that is applied.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Plug-in pump for an internal combustion engine with a receiving bore provided in the cylinder block for the plug-in pump, said pump comprising a pump part with a pump piston guided in a pump housing and an actuating part with a cam-driven and spring-loaded roller tappet, and with a lengthwise axis of said pump extending transversely to a camshaft axis, piston guides for intake and exhaust valves of each cylinder being adjacent to the receiving bore of the plug-in pump, wherein an imaginary extension of the lengthwise axis of the plug-in pump at a distance from the camshaft axis such that the imaginary extension of the lengthwise axis of the plug-in pump intersects a plane that runs perpendicularly through the camshaft axis below the camshaft axis, the pump part and the actuating part being combined into a unit by a sleeve that fits around both parts and is inserted into the receiving bore, with the roller tappet being guided in the sleeve in a lengthwise displaceable manner, a lengthwise channel passing adjacent the plug-in pump in the cylinder block as a fuel supply, a supply channel leading away from said lengthwise channel at the level of the plug-in pump, a fuel sleeve being inserted partially in the supply channel of the cylinder block and partially in a fuel line of the pump housing part in a lateral housing projection of the pump housing part of the plug-in pump that is exposed and projects from the receiving bore.

2. Plug-in pump according to claim 1, wherein the distance between the imaginary extension of the lengthwise axis of the plug-in pump and the camshaft axis roughly corresponds to one-seventh of the diameter of the roller tappet.

3. Plug-in pump according to claim 1, wherein the roller tappet contains a slot-shaped slider guide that protects against loss together with a slider on the sleeve.

4. Plug-in pump according to claim 1, wherein a lower area of the pump housing is permanently attached to an upper part of the sleeve; said sleeve abutting a pressure shoulder defined by the pump housing which is made with stages.

5. Plug-in pump according to claim 1, wherein the fuel line has a line section that is located coaxially with respect to the supply channel in the cylinder block, said section defining a step which is provided as a stop for the fuel sleeve.

6. Plug-in pump according to claim 5, wherein the line section is located in the lateral housing projection and has a recess to receive a sealing ring that surrounds the fuel sleeve under pretension.

7. Plug-in pump according to claim 1, wherein a supporting surface of the cylinder block for the exposed pump housing part together with the lateral housing projection extends transversely to the lengthwise axis of the plug-in pump, an axis of the cylinder and the lengthwise axis of the plug-in pump enclosing an angle of approximately 10°.

8. Plug-in pump for an internal combustion engine with a receiving bore provided in a cylinder block for the plug-in pump, said pump comprising a pump part with a pump piston guided in a pump housing and an actuating part with a cam-driven and spring-loaded roller tappet, said pump housing including a lateral housing projection that projects from the receiving bore, a lengthwise channel passing adjacent the plug-in pump in the cylinder block as a fuel supply, a supply channel leading away from said lengthwise channel at the level of the plug-in pump, a fuel sleeve being inserted partially in the supply channel of the cylinder block and partially in a fuel line in said lateral housing projection of the pump housing.

9. Plug-in pump according to claim 8, wherein the distance between an imaginary extension of a lengthwise axis of the plug-in pump and a camshaft axis roughly corresponds to one-seventh of the diameter of the roller tappet.

10. Plug-in pump according to claim 8, wherein the pump part and the actuating part are combined into a unit by a sleeve that fits around both parts and is inserted into the receiving bore, and wherein the roller tappet contains a slot-shaped slider guide that protects against loss together with a slider on the sleeve.

11. Plug-in pump according to claim 10, wherein a lower area of the pump housing is permanently attached to an upper part of the sleeve; said sleeve abutting a pressure shoulder defined by the pump housing which is made with stages.

12. Plug-in pump according to claim 11, wherein the fuel line has a line section that is located coaxially with respect to the supply channel in the cylinder block, said section defining a step which is provided as a stop for the fuel sleeve.

13. Plug-in pump according to claim 12, wherein the line section is located in the lateral housing projection and has a recess to receive a sealing ring that surrounds the fuel sleeve under pretension.

14. Plug-in pump according to claim 8, wherein a supporting surface of the cylinder block for the lateral housing projection extends transversely to the lengthwise axis of the plug-in pump, an axis of the cylinder and the lengthwise axis of the plug-in pump enclosing an angle of approximately 10°.

* * * * *